United States Patent [19]

Michel

[11] 4,282,696

[45] Aug. 11, 1981

[54] METHOD FOR FABRICATING AND ERECTING UNITARY STRUCTURAL ELEMENTS

[75] Inventor: Bertrand Michel, Paris, France

[73] Assignee: Societe Nord-France d'Entreprises, Generales et de Constructions en beton arne, Paris, France

[21] Appl. No.: 893,279

[22] Filed: Apr. 5, 1978

[30] Foreign Application Priority Data

Apr. 6, 1977 [FR] France ..... 77 10361

[51] Int. Cl.[3] ..... E04G 21/00

[52] U.S. Cl. ..... 52/745; 52/125; 52/247, 245; 261/DIG. 11

[58] Field of Search ..... 52/745, 125 R, 69, 80 R, 52/1247, 245; 261/DIG. 11

[56] References Cited

U.S. PATENT DOCUMENTS

| | | | |
|---|---|---|---|
| 1,276,624 | 4/1918 | Cummings | 52/69 |
| 3,300,942 | 1/1967 | Horstman | 52/745 |
| 3,300,943 | 1/1967 | Owens | 52/745 |
| 3,519,068 | 7/1970 | Harris | 261/DIG. 11 |
| 3,715,852 | 2/1973 | Koga | 52/745 |
| 3,940,902 | 3/1976 | Reale | 52/745 |
| 4,092,811 | 6/1978 | Lin | 261/DIG. 11 |

FOREIGN PATENT DOCUMENTS

| | | | |
|---|---|---|---|
| 1128114 | 4/1962 | Fed. Rep. of Germany | 52/745 |
| 711894 | 9/1931 | France | 52/745 |
| 943487 | 3/1949 | France | 52/745 |
| 439995 | 10/1948 | Italy | 52/745 |

*Primary Examiner*—Price C. Faw, Jr.
*Assistant Examiner*—Henry E. Raduazo
*Attorney, Agent, or Firm*—McDougall, Hersh & Scott

[57] ABSTRACT

Structural elements such as X-type or V-type support posts for structures such as cooling towers are each prefabricated on the ground in the position which would be occupied on the theoretical assumption that, after erection, the post had been lowered to the ground in a movement of pivotal displacement about its foot. An articulated coupling is interposed between the foot of the post and the foundation footing of the structure. On completion of the prefabrication process, the post is lifted at one end by means of a hoisting machine and moved upwards in pivotal motion about the pivot-pin of the articulated coupling. After reaching its final position, the foot of the post is embedded in a concrete block cast on the foundation footing.

3 Claims, 8 Drawing Figures

26
22
30
32
22
6'
24
20
16
18
8
28

METHOD FOR FABRICATING AND ERECTING UNITARY STRUCTURAL ELEMENTS

This invention relates to a method for fabricating and erecting unitary structural elements having in particular a substantial weight of the order of several tens of tons, for example, and having a substantial height of the order of several tens of meters, for example, after they have been erected.

The invention is applicable to the fabrication and erection of structural elements such as posts, trestles, gantries, walls and other structural elements of a similar type.

The invention applies more especially to the construction and positioning of posts for supporting buildings such as cooling towers.

It is known that, in many industries, large amounts of heat have to be removed by heat transfer and that atmospheric cooling means consisting of towers of the natural draft or forced draft type are coming into increasingly widespread use. These towers utilize the process of evaporation, thus making it possible to disperse heat in atmospheric air, with the result that local watercourses are no longer subjected to any excessive temperature rise.

In the case of electric power stations, for example, cooling towers can have a height of the order of 100 to 160 meters. It is known that the base of a cooling tower is constituted by an openwork structure formed of posts which serve to support the tower itself and leave the maximum cross-sectional area for the circulation of atmospheric air.

In the case of hyperbolic towers which are ruled surfaces, it is the usual practice to choose X-type or V-type posts having two rectilinear arms formed by prefabrication from reinforced concrete.

A major problem now encountered, however, lies in the weight and dimensions of these posts. In future design trends, it can be anticipated that cooling towers will increase in size and will therefore entail the need for base structures of the openwork or lattice type which will tend to increase both in weight and in height. On the contrary, there will be some instances where it will prove necessary to limit the height of towers, for example to 120 meters instead of 160, especially for the purpose of landscape protection. But in order to maintain sufficient cooling performances, it will be found necessary in that case to increase the air-flow cross-section at the base of the tower or, in other words, to increase the height of the openwork portion and therefore the height of the posts.

Thus it would appear desirable to construct towers in which the X-type bottom supporting posts have a height of approximately 30 meters whilst the lower portion of the X has a height of about 12 meters. This would result in a unitary weight of approximately 120 tons per post, with the result that transportation of such prefabricated structural elements and subsequent positioning of these latter would be very difficult to carry out with the handling and lifting means which exist at the present time.

The present invention makes it possible to solve this problem as well as those which could arise in the event of fabrication and erection of other unitary structural elements such as trestles, gantries, walls or like elements.

The method in accordance with the invention consists:

in prefabricating on the ground each structural element which is laid flat on the site in the theoretical position which said element would occupy on the ground after downward pivotal displacement about its base line from its final erected position;

in forming a footing in the ground at the intended location of the lower end of said structural element;

in fixing on the footing at least a first component of at least one articulated coupling and in forming on said structural element at the end adjacent to said footing at least one second component of said articulated coupling which is placed in coincident relation with the first component, said first and secomd components which constitute said articulated coupling being adapted to cooperate in such a manner as to permit pivotal displacement of the structural element about at least one horizontal axis located close to the ground and parallel to the base line of said structural element;

in upwardly displacing the structural element in pivotal motion about the aforesaid horizontal axis within said articulated coupling, said upward pivotal displacement being performed by means of a hoisting machine until said structural element is erected in the desired final position;

in supporting said structural element at least temporarily after erection in the final position;

and in permanently fixing the articulated coupling components by pouring bonding material for definitively uniting the extremity of said structural element with the footing.

The invention makes it possible to avoid any transportation of the prefabricated structural element since this latter is constructed practically in its final location and it is then only necessary to swing said element upwards to its erected position. Furthermore, the lifting or load-carrying capacity of the hoisting machine which is necessary in order to erect the structural element can be appreciably lower than the total weight of the element (50% lower in theory) since the lower end of the structural element is continuously applied against the footing by means of the aforementioned articulated coupling or couplings during the lifting operation.

In practice, prefabricated structural elements cannot be attached at the most favorable point for the achievement of a reduction in lifting effort by reason of their substantial length and of the attendant danger of deformations. A reduction of said effort by approximately 20 to 35% can nevertheless be obtained, thus permitting the use of more conventional means in order to carry out the lifting operation.

In a preferred embodiment of the method according to the invention, the first component of the articulated coupling which is rigidly fixed to the footing is pivotally coupled by means of a pin to the second component of the articulated coupling which is rigidly fixed to the foot of the structural element so as to constitute a hinge whose axis is parallel to the base line of said structural element.

In the event that the method is applied to the construction and positioning of X-type posts having two foot members which diverge from a common portion of the post structure, each of the two feet of the X is pivotally mounted on the footing by means of the aforementioned articulated coupling, the two pivot-pins of said coupling being located on a common straight line which constitutes the pivotal axis of the structural element as a whole.

The invention is also directed to a structural element which is fabricated and erected in accordance with the novel method under consideration, wherein said element is pivotally connected to the footing by means of an articulated coupling having at least one pivot-pin located parallel to the base line of the structural element and wherein said articulated coupling is then embedded in an anchoring block especially of concrete for rigidly fixing the foot or feet of the structural element with respect to the footing.

The invention is finally directed to any structure comprising unitary structural elements fabricated and erected in accordance with the novel method under consideration.

A more complete understanding of the invention will be gained from the following detailed description and from a study of the accompanying drawings in which a number of embodiments of the invention are illustrated by way of example and not in any limiting sense, and wherein.

Figure 1:
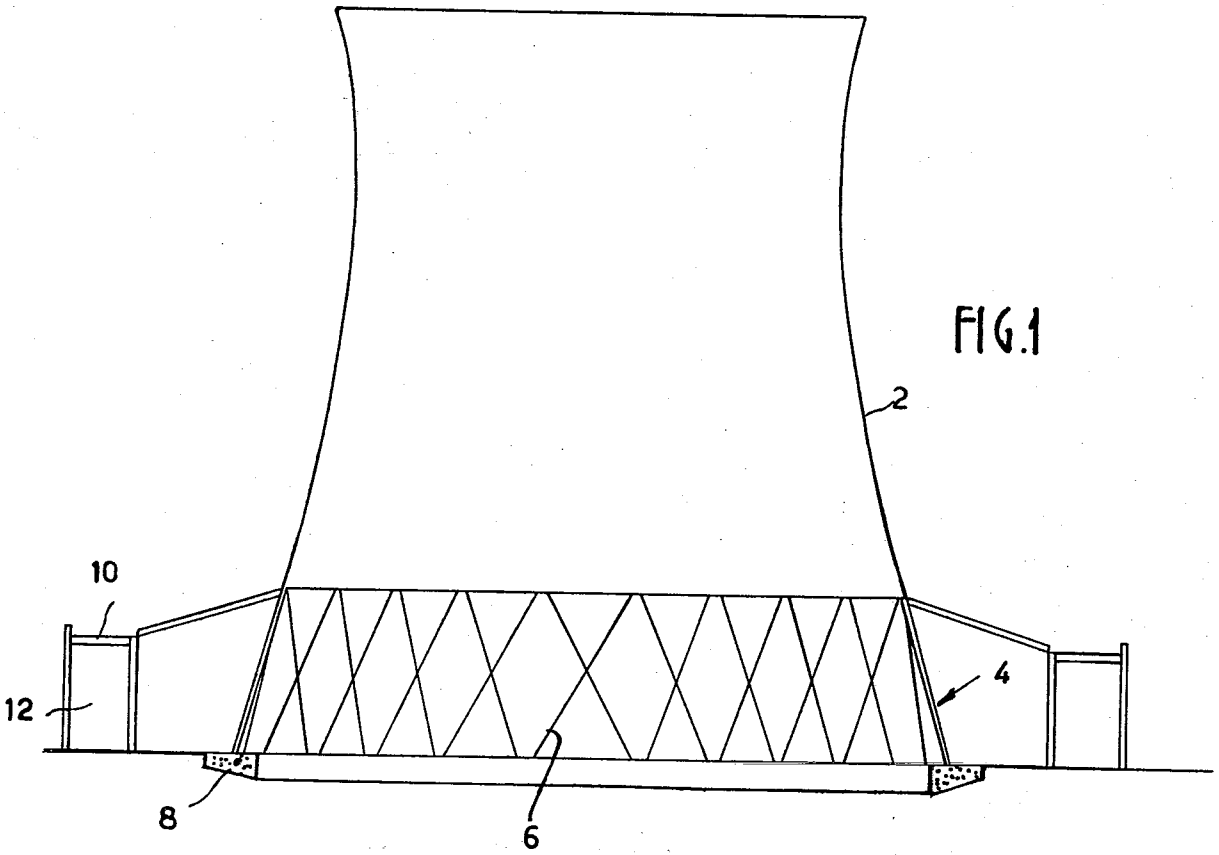
FIG. 1 is a view in elevation showing a cooling tower, the base of said tower being formed of structural elements which are fabricated and erected in accordance with the invention.

Reference will first be made to FIG. 1, which is a diagrammatic view in elevation of an atmospheric cooling tower, the construction of which constitutes a primary objective of the present invention. Cooling towers of this class are well known and it need only be recalled that a typical design consists of a body or discharge stack 2 which usually has the shape of a hyperboloid of revolution. The stack rests on a lattice structure 4 made up of X-shaped posts 6 anchored in a footing 8 which has a circular shape and serves as a foundation for the tower. Water is admitted into a circular channel 10 surrounding the base of the tower and is discharged into the bottom space 12 in a descending spray, with the result that the air which is sucked into the base of the tower is charged with moisture. In towers of this type, air circulation can be produced either by natural draft or forced draft.

The height of these towers can attain approximately 120 to 160 meters with a mean diameter of 80 to 100 meters whilst the openwork base structure can have a height of approximately 25 meters.

In the case of a hyperbolic tower, the posts in the erected position can be inclined at an angle of 15° to 20° with respect to the vertical, with the result that they have a length in the vicinity of 30 meters and a unitary weight which can attain 120 tons. In similar structures, V-shaped posts can also be employed both for fabrication and erection, and the method in accordance with the invention is equally applicable to this type of post.

Figure 4:
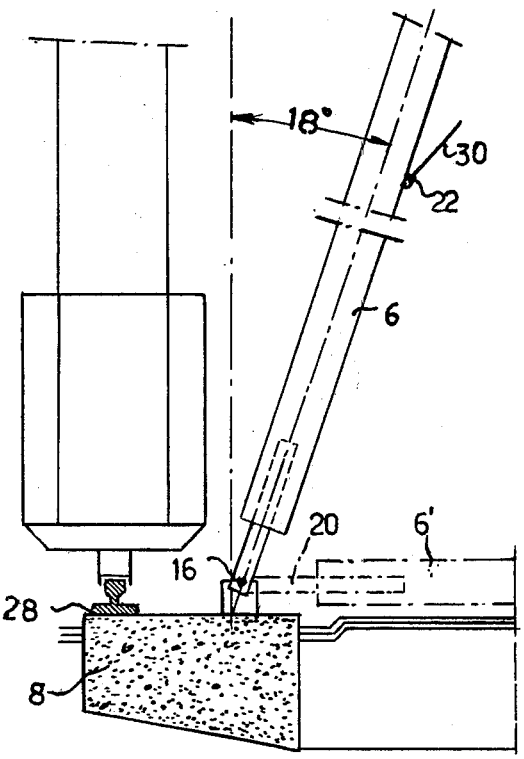
FIG. 4 is a partial view of the lower end of a post and of its pivotal articulation with respect to the footing.
Figure 5:
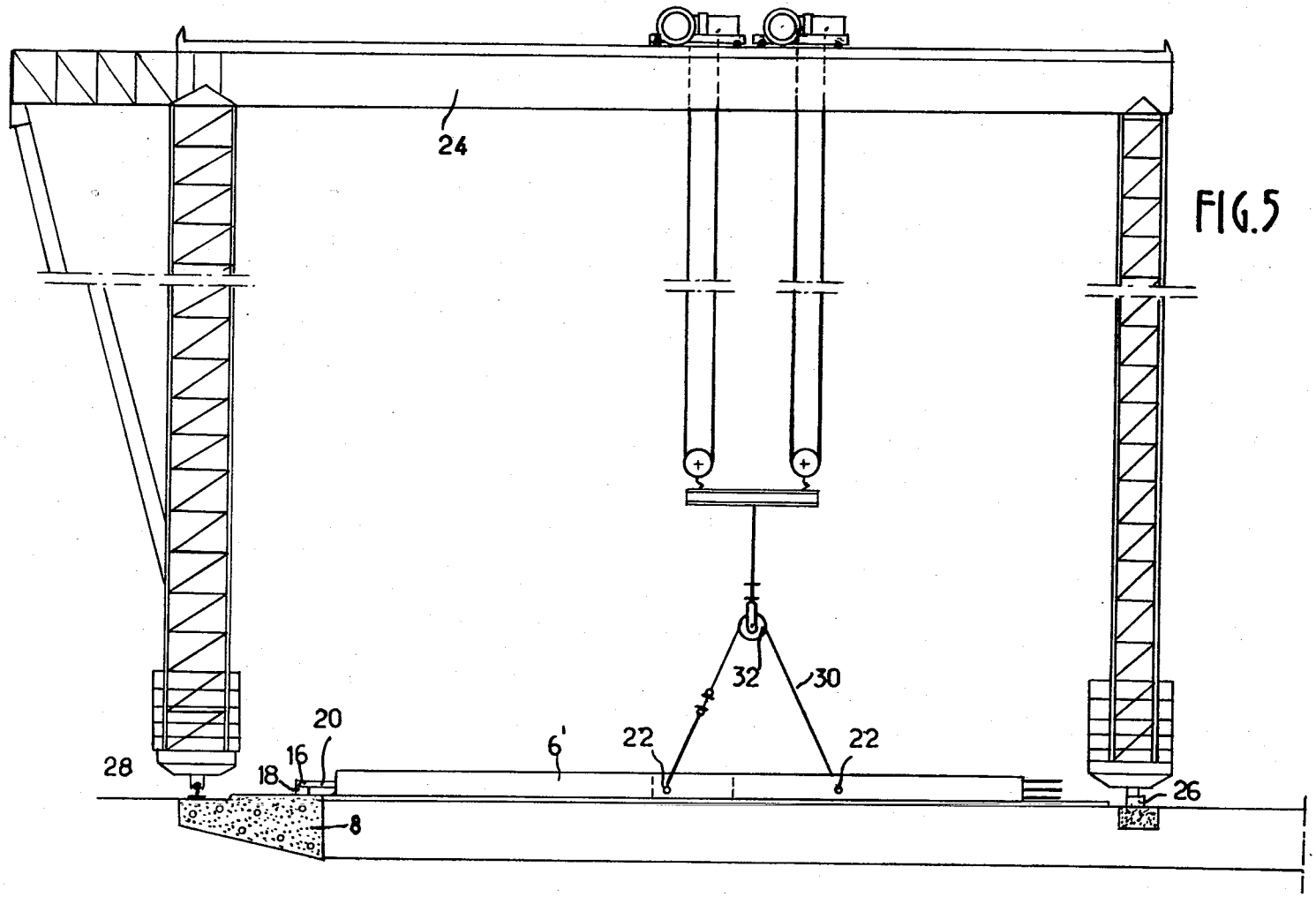
Figure 7:
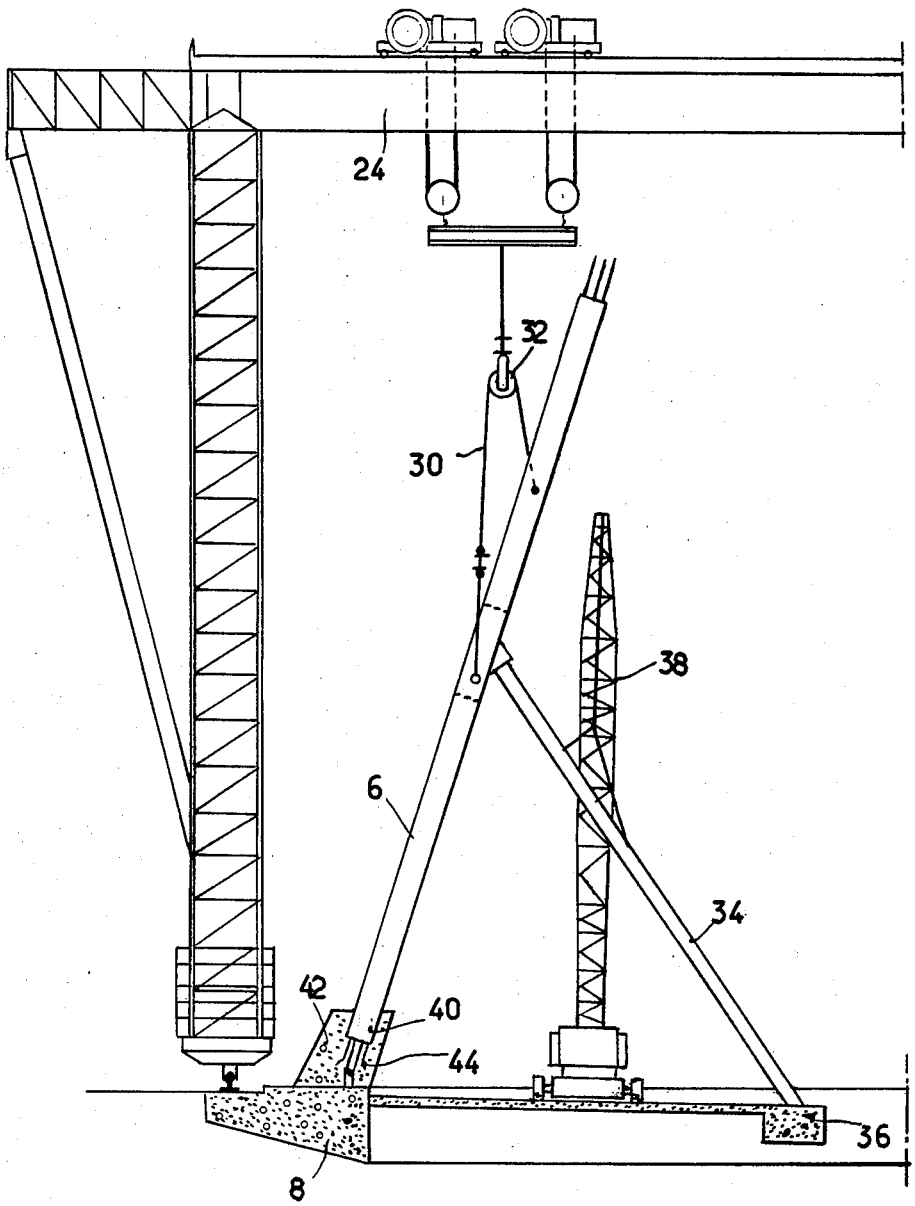

The method will now be described with reference to FIGS. 3 to 5. It must be noted in connection with FIG. 3 that one out of two posts is shown in the erected position (reference 6) and one out of two posts is shown in the position designated by the reference 6' in which it is laid on the ground.

The initial operation consists in conventional placement of the circular footing 8 which will serve as a foundation for the posts. There are then mounted on the ground one or a number of forms 14 (FIG. 3), the position of which is determined in such a manner as to ensure that the reinforced concrete X-posts which are cast on the ground are exactly in the theoretical position which they would occupy after displacement from their erect position in pivotal motion about a horizontal axis 16 which passes through both feet of the posts.

The first component of an articulated coupling which permits pivotal displacement of the post about the axis 16 is fixed on the footing 8 in the position-location of each foot. By way of example, said first component consists of a yoke 18 as shown in FIG. 5. At the time of casting of the post, provision is made for an extension at the lower end of the post for a coupling member such as a metallic tube 20, for example. The tube itself can constitute the second component of the articulated coupling and can carry a second yoke 50 as will be noted hereinafter in reference to FIG. 8.

A pivot-shaft 16' engaged in the yokes along the axis 16 provides a coupling between the two yokes in order to form a hinge.

As can readily be understood, it is also possible to adopt other types of articulated coupling such as universal joint assemblies or to contemplate the use of articulated coupling systems in which no provision is made for a pivot-shaft. One expedient can accordingly consist simply in forming in the footing 8 a hollow recess of either cylindrical or hemispherical shape. Thus the suitably shaped extremity of the aforementioned tube 20 or of the foot itself of the post is capable of engaging in said recess and of pivotal motion in the same manner as a knee-action mechanism.

After removal of formwork, the post 6' is therefore located in its exact horizontal position on the ground and is attached to the footing 8 by means of two articulated couplings (in the case of an X-type or a V-type post).

At the time of casting of the post, provision is made for at least one and preferably two hook-engagement points 22 (FIGS. 4 and 5) for erecting the post by pivotal displacement about its articulated coupling by means of a hoisting machine.

By way of example, the hoisting machine can consist of a mobile crane. However, in the case of construction of a cooling tower which may be constituted by several tens of posts, it is more advantageous to adopt a traveling bridge crane 24 which spans the entire circular zone of construction of the posts on the ground and travels on two concentric tracks 26–28, the outer track being advantageously supported by the footing 8.

The lifting operation itself is illustrated in FIGS. 4 to 7; it need only be added that the choice of several hook-engagement points 22 avoids the risk of subjecting the post to excessive bending stresses during the lifting operation. Attachment of the hook-engagement points 22 to the cable or cables of the traveling bridge crane 24 is preferably carried out by means of a sling 30 which travels on a pulley 32 during the lifting operation.

It is already apparent from the foregoing that the prefabricated post does not require any handling on the ground; that any need for accurate positioning of the feet at the end of the lifting operation is dispensed with since the feet are continuously attached to the footing by means of their articulated couplings, precisely in the positions which they are intended to occupy on the footing; and finally that the hoisting machine can be of a type which is appreciably lighter than the weight of the posts since the stresses are largely transferred to the ground on the footing 8 by means of the articulated couplings. It is thus possible in practice to reduce the lifting capacity of the hoisting machine by approximately 20 to 30%, which is highly appreciable when the structural elements employed weigh over 100 tons.

When the structural element has been erected in the final position desired, for example the vertical position if the structural element is a wall or a gantry, or else a position close to the vertical (FIG. 6) as in the case of posts which serve as bearing supports for a tower having a hyperbolic profile, said structural element is maintained in position temporarily by suitable retaining means.

In the case of a vertical structural element, use can accordingly be made of props, guy-ropes, tightening wedges and like means of a conventional type.

In the case shown in the figures in which the posts are inclined, a prop 34 is placed in position and can also be lifted by pivotal displacement about a horizontal axis 36 by means of a hoisting machine 38. However, the much lighter weight of this strut permits positioning by conventional means.

The post 6 can then be detached from the traveling bridge crane 24. The only remaining operation consists in permanently securing each foot 40 of the post of the footing 8 by means of two concrete anchoring blocks 42 which are cast in situ and in which are embedded the steel reinforcing rods 44, said rods having been left free and in readiness at the end of the concrete post.

It should be noted that the articulated couplings between the feet of the posts and the foundation footing and, more precisely, the pivot-pins of said couplings (if provision is made for pivot-pins) are subjected to stresses only at the moment of lifting and then at least to the partial weight of the posts themselves when they have been erected. By virtue of the anchorage provided by the concrete blocks 42, the articulated couplings are no longer under working stress. In particular, they are no longer subjected to the stresses arising from construction work above the supporting lattice structure constituted by the posts. In consequence, the construction of these articulated couplings does not present any special problem.

Construction work then proceeds from one post to the next by displacing the formwork 14 to the following location. Similarly, the traveling bridge crane passes from position 24 to position 24' (as shown in FIG. 3).

Figure 3:
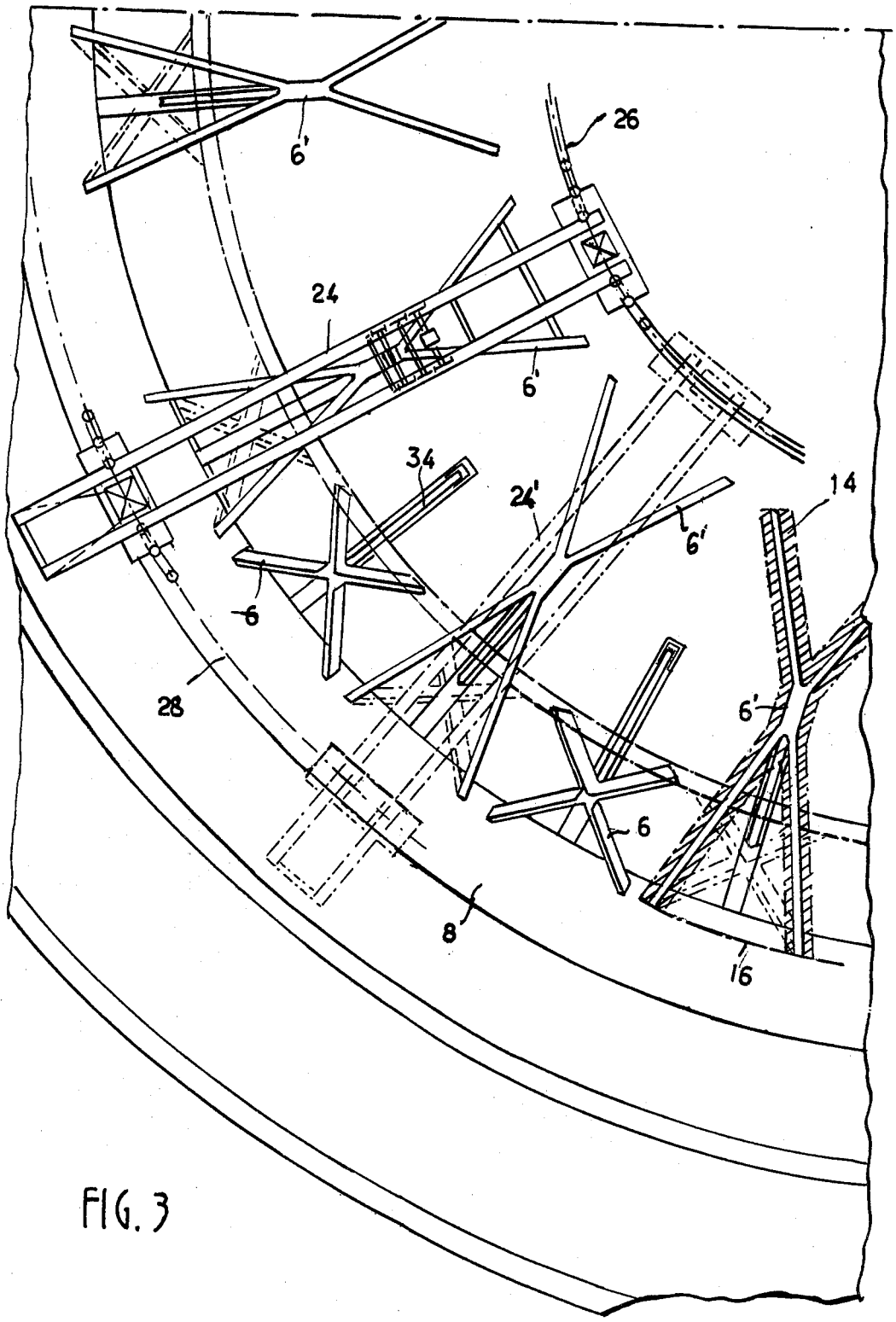
FIG. 3 is a partial plan view of the base of the tower and illustrates the prefabrication, on the ground, of the X-posts which form said base.
Figure 6:
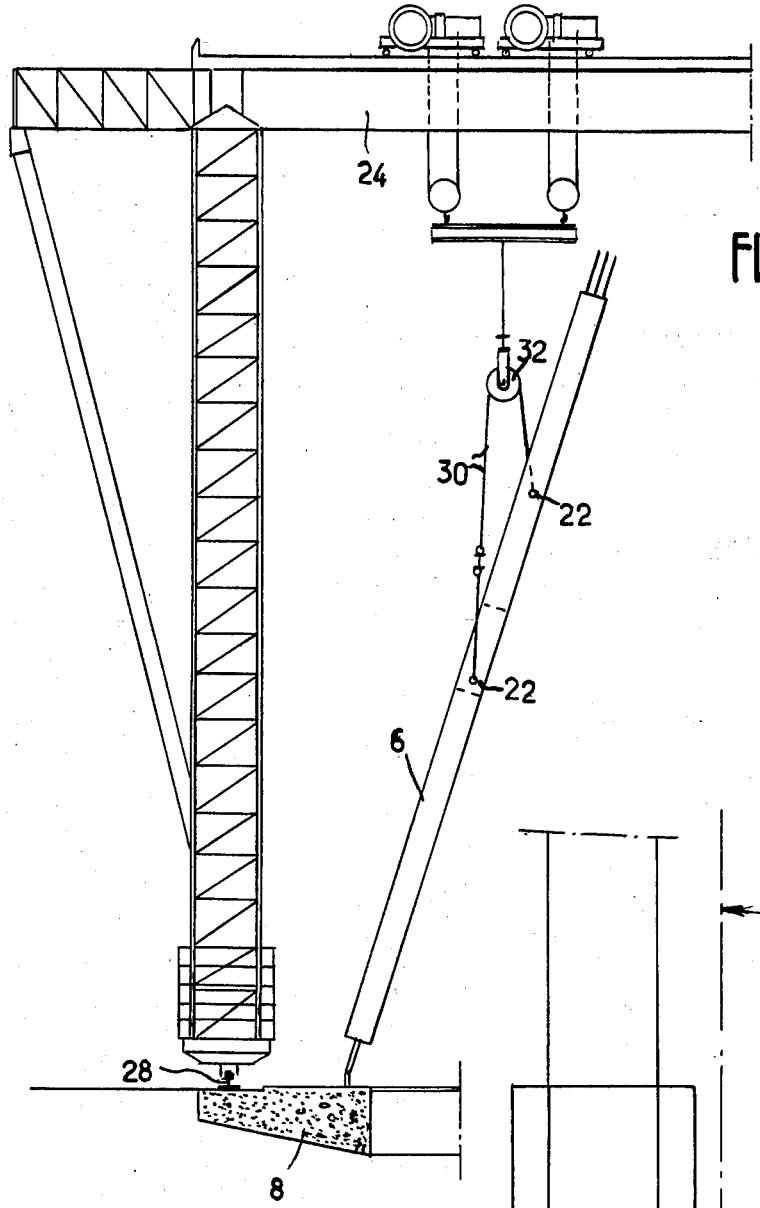
FIGS. 5, 6 and 7 show different stages of the operations performed in order to erect and support the posts.

In the case illustrated in the drawings and relating to the construction of a cooling tower, it is preferable as shown in FIG. 3 to prefabricate and erect one or two of the posts (namely the posts 6 in FIG. 3), then to perform the same operations on the intermediate posts (namely the posts 6' in FIG. 3).

In order to reduce the lifting effort at the beginning of the lifting operation, arrangements can be made with a view to placing the forms 14, not horizontally and directly on the ground, but on an inclined plane or ramp. Thus the prefabricated post which is pivotally coupled to the footing 8 is already positioned at an angle of slope which has the effect of transferring part of the weight to the articulated coupling and accordingly reduces the load on the hoisting machine.

Figure 2:
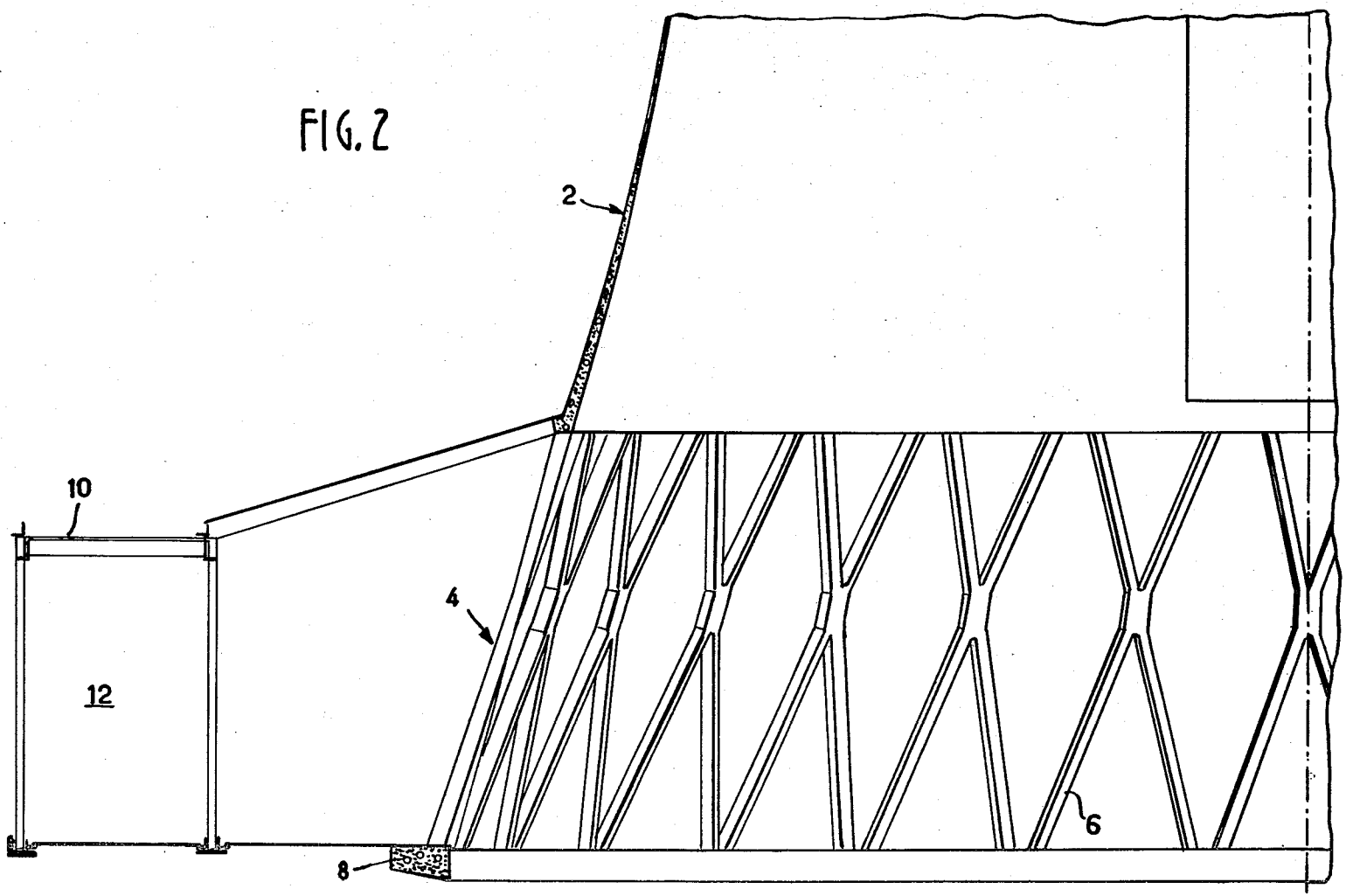
FIG. 2 is a partial view in elevation to a larger scale and showing the completed base of the tower.

When all the posts have been erected, the construction work continues in the conventional manner. Thus a ring beam (FIG. 2) which may be prefabricated if necessary is placed in position on top of the posts in such a manner that the latticework structure of the tower is made permanently non-deformable.

As will be readily apparent, the same method of construction and erection can be applied to unitary structural elements other than the X-posts which have been more especially described in the foregoing. From this it follows that other types of posts (such as V-posts, for example), gantries, trestles, walls, can accordingly be constructed and erected.

Different types of articulated couplings can be contemplated for the purpose of establishing a pivotal connection between the base of the structural element and the footing. Provision can be made for at least one articulated coupling for each structural element. Thus more than two articulated couplings can be provided for each element.

Figure 8:
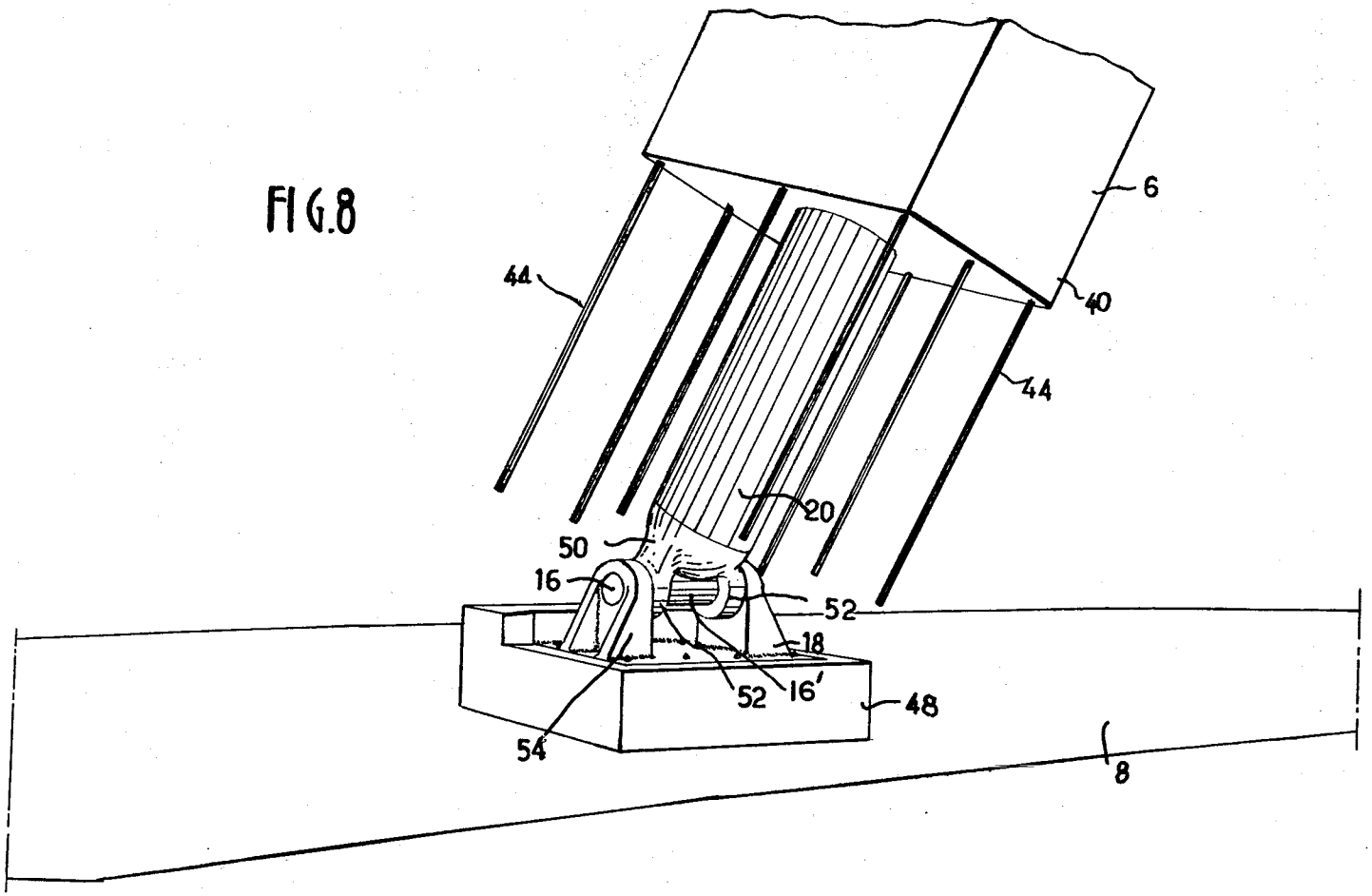
FIG. 8 is a view in perspective showing an articulated coupling between the foot of a post and the foundation footing of the structure.

There is shown in FIG. 8 a type of articulated coupling which can advantageously be employed, especially for X-type or V-type posts.

The articulated coupling is made up of a first yoke 18 of steel, for example, which is anchored by means of stirrup-pieces or tie-bolts in a concrete base 48 formed on the footing 8.

The second articulated coupling component can be constituted by a second yoke 50 also of steel and provided with two ears 52 which are engaged between the support brackets 54 of the first yoke. The upper portion of the second yoke 50 has a cylindrical shape in order to permit fitting and welding of this latter within the tube 20 which projects from the foot 40 of each post 6 after removal of the formwork.

The two yokes are then coupled together by means of the pivot-pin 16 which is also of steel. The concrete anchoring block 42 (FIG. 7) in which the articulated coupling is then embedded surrounds both the foot 40 of the post, the steel reinforcing rods 44 which had been left free and in readiness and the base 48 of the yoke 18, the end result thereby achieved being that the metallic hinge unit 18-50-16 is no longer subjected to working stress.

We claim:

1. In a method of forming a cooling tower having a base ring which is spaced above the ground by means of a plurality of peripherally disposed supporting posts, the steps comprising:

(a) constructing in the ground a circular footing (8) of an outer diameter greater than the diameter of what will become said base ring, (b) preforming on the ground a plurality of adjacent substantially horizontal supporting post structures (6) each of which is formed with two foot members having free ends and which diverge from a common portion of the post structure toward such locations on said footing such that each preformed post structure extends from the footing in a different radial direction relative thereto, (c) disposing a plurality of pairs of horizontal pivotal shafts in a circular row (16) on said footing and positioning said pairs of pivotal shafts in such a manner with respect to said performed post structures that the distance between one of the pivotal shafts of each pair and the other pivotal shaft of the pair corresponds to the distance between the free ends of said divergent foot members, that the axis of said one pivotal shaft is perpendicular to a vertical radial plane passing between said one pivotal shaft and said other pivotal shaft, and that the axis of said other pivotal shaft coincides with the axis of said one pivotal shaft, (d) securing the thus positioned pivotal shafts to the footing, (e) securing the two free ends of the foot members to the corresponding pivotal shafts for pivotal motion thereabout, (f) exerting successively on each post structure a continuous tractive force capable of pivoting the post structure to the supporting position thereof, (g) temporarily supporting the thus raised post structure with a prop, and (h) embedding the pivotal connection between the raised post structure and the footing in concrete.

2. In the method as defined in claim 1, the step of forming on the ground area corresponding to the preformation places for said post structures an annular embankment which slopes downwardly to said circular footing and the width of which corresponds substantially to the length of the post structures to be preformed on said places.

3. In the method as defined in claim 1, the step of constructing on said footing a circular track concentric with said row of pivotal shafts for supporting a travelling hoisting machine capable of exerting said tractive force on any of said horizontal post structures.

* * * * *